US005914307A

United States Patent [19]

DeNome et al.

[11] Patent Number: 5,914,307

[45] Date of Patent: Jun. 22, 1999

[54] PROCESS FOR MAKING A HIGH DENSITY DETERGENT COMPOSITION VIA POST DRYING MIXING/DENSIFICATION

[75] Inventors: Frank William DeNome, Cincinnati, Ohio; John Frederick Lange, Villa Hills, Ky.

[73] Assignee: The Procter & Gamble Company, Cincinnati, Ohio

[21] Appl. No.: 08/729,306

[22] Filed: Oct. 15, 1996

[51] Int. Cl.[6] ..... C11D 11/00

[52] U.S. Cl. ..... 510/444; 510/457; 510/512; 510/231

[58] Field of Search ..... 510/444, 220, 510/224, 231, 457, 512

[56] References Cited

U.S. PATENT DOCUMENTS

| | | | |
|---|---|---|---|
| H1604 | 11/1996 | Welch et al. | 510/441 |
| 2,895,916 | 7/1959 | Milenkevich et al. | 252/99 |
| 3,247,118 | 4/1966 | Matthaei | 252/99 |
| 3,625,902 | 12/1971 | Sumner | 252/99 |
| 3,933,670 | 1/1976 | Brill et al. | 252/99 |
| 4,427,417 | 1/1984 | Proasik | 23/313 |
| 4,846,409 | 7/1989 | Kaspar et al. | 241/21 |
| 4,917,812 | 4/1990 | Cilley | 252/99 |
| 5,108,646 | 4/1992 | Beerse et al. | 252/174.25 |
| 5,133,924 | 7/1992 | Appel et al. | 264/342 |
| 5,160,657 | 11/1992 | Bortolotti et al. | 252/174.14 |
| 5,205,958 | 4/1993 | Swatling et al. | 252/174.13 |
| 5,358,655 | 10/1994 | Kruse et al. | 252/95 |
| 5,366,652 | 11/1994 | Capeci et al. | 252/89.1 |
| 5,486,303 | 1/1996 | Capeci et al. | 252/89.1 |
| 5,489,292 | 2/1996 | Capeci et al. | 252/89.1 |
| 5,516,448 | 5/1996 | Capeci et al. | 252/89.1 |
| 5,554,587 | 9/1996 | Capeci | 510/444 |
| 5,605,883 | 2/1997 | Iliff et al. | 510/444 |

FOREIGN PATENT DOCUMENTS

| | | | |
|---|---|---|---|
| 0351937 B1 | 2/1994 | European Pat. Off. | C11D 11/00 |
| 0451894 B1 | 5/1995 | European Pat. Off. | C11D 10/04 |
| 1517713 | 7/1978 | United Kingdom | C11D 17/06 |

*Primary Examiner*—Douglas J. McGinty
*Assistant Examiner*—Lorna M. Douyon
*Attorney, Agent, or Firm*—Brian M. Bolam; Kim William Zerby

[57] ABSTRACT

A process for preparing a high density detergent-composition is provided. The process comprises the steps of:

a) drying detergent agglomerates to a free moisture content of less than about 7% by weight thereby forming substantially dry detergent agglomerates; and b) charging the substantially dry detergent agglomerates into a moderate speed mixer/densifier to densify the substantially dry detergent agglomerates to form a high density detergent having a density of at least about 900 g/l. In preferred embodiments, the process also comprises forming hydrated detergent agglomerates via the steps of hydrating an anhydrous hydratable detergent salt to a degree of hydration of at least about 60% and agglomerating the hydrated detergent salt by charging the hydrated detergent salt and additional detergent ingredients into a high speed mixer/densifier and agglomerating the hydrated detergent salt and additional detergent ingredients to form hydrated detergent agglomerates.

18 Claims, 1 Drawing Sheet

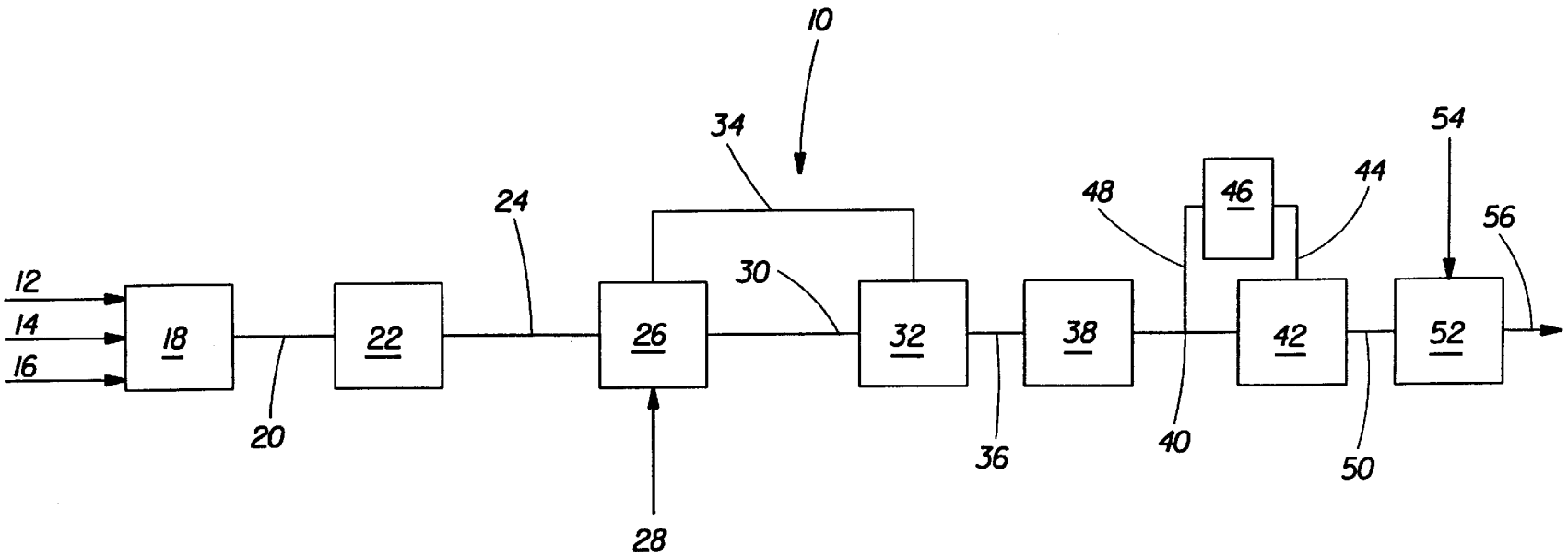
10
12
14
16
18
20
22
24
26
28
30
32
34
36
38
40
42
44
46
48
50
52
54
56

PROCESS FOR MAKING A HIGH DENSITY DETERGENT COMPOSITION VIA POST DRYING MIXING/DENSIFICATION

FIELD OF THE INVENTION

The present invention relates to a process for making a high density detergent composition via a post drying mixing/densification process. More particularly, the present invention relates to a process for making a detergent composition by agglomerating a detergent salt, drying the agglomerated composition and mixing/densifying the dry agglomerates to form a high density detergent composition.

BACKGROUND OF THE INVENTION

Recently, there has been considerable interest within the detergent industry for detergents which are "compact" and therefore, have lower dosage volumes. As a result, many attempts have been made to produce higher bulk density detergents. Compact detergents are currently in high demand as they conserve resources and are more convenient for consumers.

Generally, there have been two primary types of processes by which detergent particles or powders can be prepared. The first type of process involves spray-drying an aqueous detergent slurry in a spray-drying tower to produce highly porous detergent particles. In the second type of process, the various detergent ingredients are mixed after which they are agglomerated with an agglomeration agent or binder. In both processes, the most important factors which govern the density of the resulting detergent granules are the density, porosity, particle size and surface area of the various starting ingredients. These parameters, however, can only be varied within a limited range and through an agglomeration process alone density typically ranges from 700–750 g/l (Porasik, U.S. Pat. No. 4,427,417). Thus, these processes have been unable to consistently deliver a detergent bulk density higher than 900 g/l with an acceptable particle size distribution so as not to cause problems with product flowing or clumping.

There have been many attempts in the art for increasing the bulk density of detergent particles or powders. Particular attention has been given to densification of spray-dried particles by "post-tower" treatments. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide a continuous process for increasing the density of "post-tower" or spray dried detergent particles. Typically, such processes require a first apparatus which pulverizes or grinds the particles and a second apparatus which increases the density of the pulverized particles by agglomeration. These processes achieve the desired increase in density only by treating or densifying "post-tower" or spray-dried particles.

However, all of the aforementioned processes are directed primarily for densifying or otherwise processing spray dried particles. Currently, the relative amounts and types of ingredients which can be subjected to spray-drying is limited. In addition, the relative capital cost for spray drying equipment and energy consumption are prohibitive for high volume detergent products.

To that end, many attempts have been made to discover satisfactory agglomeration techniques for producing granular detergent products. However, the processes to date have been unable to produce agglomerated high density detergent products which have a density of at least about 900 g/l which also display acceptable particle size ranges. For acceptable consumer detergent products high levels of undersized particles ("fines") create dust during pouring, create free flowing or clumping problems, and display undesirable product appearance. Current agglomeration processes that produce detergent products with a high bulk density generate inordinate amounts of undersized particles ("fines"), and thus, fail to provide acceptable particle size distributions so as not to cause problems with product flowing or clumping.

Accordingly, there remains a need in the art for a process which produces a high density detergent composition having superior flow and particle size properties. Also, there remains a need for such a process which is more efficient and economical to facilitate large-scale production of high density detergent products.

BACKGROUND ART

The following references are directed toward the processing of detergent compositions: Milenkevich et al., U.S. Pat. No. 2,895,916; Sumner, U.S. Pat. No. 3,625,902; Brill et al., U.S. Pat. No. 3,933,670; Porasik, U.S. Pat. No. 4,427,417; Beerse et al., U.S. Pat. No. 5,108,646; Appel et al., U.S. Pat. No. 5,133,924; Bortolotti et al., U.S. Pat. No. 160,657, Swatling et al., U.S. Pat. No. 5,205,958; Capeci et al., U.S. Pat. No. 5,366,652; Capeci et al., U.S. Pat. No. 5,516,448; Capeci et al., U.S. Pat. No. 5,554,587; Johnson et al, British Pat. No. 1,517,713; Hollingsworth et al., European Patent Application 351,937; Curtis, European Patent Application, 451,894.

SUMMARY OF THE INVENTION

The present invention meets the aforementioned needs by providing a process for continuously producing a high density detergent composition. The high density detergent composition is an agglomerated product and can be produced directly from starting ingredients. The process of the present invention employs a moderate speed mixer/densifier in a post drying step to increase the density of the agglomerates without generating unacceptable amounts of undersized or oversized particles. Preferably, the moderate speed mixer/densifier directly or immediately follows the drying step without significant intermediate processing such as grinding or additional agglomerating and without the addition of binders or other additives to increase density. The process of the present invention achieves the desired high density detergent composition without unnecessary process parameters or steps, such as the use of spray drying or high operating temperatures, all of which increase manufacturing costs. The agglomerated detergent as provided herein has improved flow and particle size properties which results in higher consumer acceptance of the product.

According to a first aspect of the present invention, a process for continuously preparing a high density detergent composition is provided. The process comprises the steps of:

a) continuously drying detergent agglomerates to a free moisture content of less than about 7% by weight moisture thereby forming substantially dry detergent agglomerates; and b) continuously charging the substantially dry detergent agglomerates into a moderate speed mixer/densifier to densify the substantially dry detergent agglomerates to form a high density detergent having a density of at least about 900 g/l, preferably from about 900 to about 1200 g/l, and most preferably about from about 950 to about 1150 g/l.

The process may further comprise the step of passing the substantially dry detergent agglomerates through the mixer so that the mean residence time of the agglomerates in the moderate speed mixer/densifier is from about 3 minutes to about 20 minutes, more preferably from about 4 minutes to about 15 minutes. The process of the present invention may also further comprise the step of charging the substantially dry detergent agglomerates into the moderate speed mixer/densifier at a rate such that the percentage of mixer fill is no less than 10%, more preferably no less than 20%. The process may also comprise the step of operating the moderate speed mixer/densifier at a shear rate of from about 100 to about 900 inverse seconds, more preferably from about 200 to about 800 inverse seconds.

According to another aspect of the present invention, a process for continuously preparing a high density detergent composition comprising the steps of:

a) continuously agglomerating detergent salts by charging them and additional detergent ingredients into a high speed mixer/densifier and agglomerating the detergent salts and additional detergent ingredients to form detergent agglomerates;

c) continuously drying the detergent agglomerates to a free moisture content of less than about 7% by weight moisture thereby forming substantially dry detergent agglomerates; and d) continuously charging the substantially dry detergent agglomerates into a moderate speed mixer/densifier to densify the substantially dry detergent agglomerates to form a high density detergent having a density of at least about 900 g/l, preferably from about 900 to about 1200 g/l, is provided.

The process may also comprise the steps of passing the substantially dry detergent agglomerates through the mixer so that the mean residence time of the agglomerates in the moderate speed mixer/densifier is from about 3 minutes to about 20 minutes, more preferably from about 4 minutes to about 15 minutes, charging the substantially dry detergent agglomerates into the moderate speed mixer/densifier at a rate such that the percentage of mixer fill is no less than 10% and operating the moderate speed mixer/densifier at a shear rate of from about 100 to about 900 inverse seconds.

Preferably, the process employs hydratable detergent salts and, thus, further comprises the step of continuously hydrating an anhydrous hydratable detergent salt to a degree of hydration of at least about 60%. The step of hydrating the anhydrous detergent salt may further comprise the steps of charging the anhydrous detergent salt, water and a surfactant into a high speed mixer/densifier and mixing the anhydrous salt, water and surfactant to form a hydrated detergent salt. The hydratable detergent salt is selected from the group consisting of alkali metal phosphates, alkali metal carbonates, and mixtures thereof.

The additional detergent ingredients in the step of agglomerating may be selected from the group consisting of hydratable and non-hydratable detergent salts, surfactants, detergent fillers, coloring agents, bleaching agents, agglomerating agents, and mixtures thereof. More preferably, the additional detergent ingredients are selected from the group consisting of alkali metal carbonates, alkali metal silicates, alkali metal sulfates, and mixtures thereof. The step of continuously drying the hydrated detergent agglomerates may further comprise the step of continuously charging the hydrated detergent agglomerates to a fluid bed dryer which is preferably operated at a product temperature of from about 30° C. to about 100° C. In additional embodiments of the present invention, detergent compositions produced by the aforementioned processes are provided.

Accordingly, it is an object of the present invention to provide a process for producing a high density detergent composition which has a density of at least about 900 g/l with an acceptable particle size distribution so as not to cause problems with product free flowing or clumping or display undesirable product appearance. It also an object of the present invention to provide a process for producing such high density detergents via an agglomeration process and post drying mixing/densifying. It is further an object of the present invention to provide a process which produces a high density detergent composition having superior flow and particle size properties and which is more efficient and economical to facilitate large-scale production of high density detergent products. These and other objects, features and advantages will become apparent to those of ordinary skill in the art from a reading of the following detailed description, the drawings and the appended claims.

All percentages, ratios and proportions herein are on a weight basis unless otherwise indicated. All documents cited herein are hereby incorporated by reference.

BRIEF DESCRIPTION OF THE DRAWINGS

The FIGURE is a flow diagram of a process in accordance with the preffered embodiment of the present invention.

DETAILED DESCRIPTION OF THE PREFERRED EMBODIMENTS

The present invention is directed toward a continuous process for producing high density detergent compositions, particularly high density automatic dishwashing detergent compositions. By "high density" in the present application it is intended that the detergent compositions have an average bulk density of at least about 900 g/l, preferably about 900 to about 1200 g/l, more preferably from about 950 to about 1150 g/l, and most preferably from about 1000 to about 1100 g/l. The detergent compositions produced by the process of the present invention in addition to having high density are also free flowing and Within satisfactory particle size distributions for consumer detergent products.

The process of the present invention at its simplest involves the continuous drying of detergent agglomerates followed by passing the substantially dry detergent agglomerates through a moderate speed mixer/densifier. The moderate speed mixer/densifier of the present invention acts to increase the bulk density of the dry detergent compositions as well as improve the particle size distribution of the product. In addition, the surface appearance of the particles of the final product are also improved. Upon leaving the drying step, the particles of the present invention have a typical agglomerated appearance. However, upon leaving the moderate speed mixer/densifier, the particles of the present invention have a rounded or "ball-like" shape. Accordingly, the process of the present invention improves not only the bulk density of the detergent composition, but improves the appearance of the particles as well.

Process

Referring to the FIGURE, the preferred process 10 of the present invention entails first hydrating an anhydrous detergent salt in hydration step 18, agglomerating the hydrated detergent salt in agglomeration step 26, drying the agglomerated detergent in drying step 32 and then densifying the substantially dry agglomerates in a moderate speed mixer/densifier in densification step 38. Hydration, agglomeration and drying of detergent salts in the manufacture of detergent compositions is well-known and is disclosed for example in U.S. Pat. No. 4,427,417 to Porasik, the disclosure of which is herein incorporated by reference.

The hydration step 18 involves continuously charging an anhydrous detergent salt 12, water 14 and a surfactant 16 into a mixing apparatus (not shown) which may include but is not limited to a high speed mixer/densifier (not shown). Of course one of ordinary skill in the art will recognize that while the preferred process is a continuous process, the present invention may be operated in batch format as well. Anhydrous detergent salt 12 may be any anhydrous detergent salt as is well-known in the art but is preferably a phosphate or a carbonate salt. Surfactant 16 may also be any well-known surfactant including nonionic, anionic, cationic, zwitterionic and amphoteric surfactants. Preferably, surfactant 16 is a nonionic surfactant and most preferably a low foaming nonionic surfactant all of which are well-known in the art. The amount of water added to the mixer may be at least enough to provide a stoichiometric amount for hydration but typically will not exceed more than 20% over the stoichiometric amount for hydration. Of course, one of ordinary skill in the art will recognize that if non-hydratable or previously hydrated detergents salts are employed in the present invention, then hydration step 18 will not be required and the salts may be passed to agglomeration step 26.

The high speed mixer/densifier as employed in the present invention may be any of a number of commercially available high speed mixer/densifiers such as a Schugi blender/agglomerator or a Lödige CB mixer. Other mixing devices may be employed in the present invention and may include conventional twin-screw mixers and these and other high speed mixers are commercially available from a number of sources. As employed in the present invention, "high speed mixer/densifier" is one which has a central shaft speed of at least about 750 RPM, more preferably at least about 1000 RPM and most preferably at least about 1200 RPM. The preferred high speed mixer/densifier for use in the present invention is a K-G/Schugi blender-agglomerator. The Schugi blender-agglomerator has a central rotating shaft with multiple rotating blades extending from the central shaft and a flexible outer rubber wall to prevent build-up of particles on the outer wall. The mean residence time within the preferred high speed mixer, typically on the order of 5 seconds or less.

Upon discharge from the high speed mixer/densifier, the partially hydrated particles are continuously passed through at least one or a series of hydrator continuators (not shown). The hydrator continuator helps ensure maximum possible hydration of the detergent salt particles. The hydrator continuator is a low speed mixer comprised of a closed container with a rotating agitator shaft for gently stirring the particles. The shaft is typically rotated at speeds on the order of from about 10 to about 40 RPM. Substantial hydration of at least about 60%, preferably at least about 70% is typically achieved in the hydrator or series of hydrators in less than about 45 minutes and more preferably about 30 minutes.

Upon exiting the hydrator continuator and thus hydration step 18, the hydrated detergent salt particles 20 are continuously discharged to grinding step 22 wherein oversized lumps or aggregates of particles are reduced in size. Grinding step 22 employs conventional grinding equipment (not shown) which is commercially available from a number of sources. Upon exiting grinding step 22, the properly sized hydrated detergent salt particles 24 are continuously passed to agglomeration step 26.

Agglomeration step 26 comprises continuously charging at least one second high speed mixer/densifier (not shown), substantially as described above, with the properly sized hydrated detergent salt particles 24 and any additional detergent ingredients 28 which may be desired for addition to a detergent agglomerate composition. In agglomeration step 26, the hydrated particles 24 and any additional added ingredients 28 are formed into detergent agglomerates. Such additional detergent ingredients 28 are well-known in the art of detergent compositions and may vary greatly depending upon the desired detergent composition. Typical additional detergent ingredients include, but are not limited to, hydratable and nonhydratable detergent salts, detergent fillers, surfactants, coloring agents, bleaching agents, agglomerating agents and mixtures thereof. Preferred additional ingredients include alkali metal carbonates, silicates, sulfates, and mixtures thereof. Of course, one of ordinary skill in the art will recognize that the types and amounts of additional ingredients may vary greatly and will depend upon the final desired composition and the use of that composition. Again, the preferred high speed mixer/densifier for use in the agglomeration step of the present invention is a K-G/Schugi blender-agglomerator operated at mean residence times on the order of 5 seconds or less.

The hydrated detergent agglomerates 30 which are discharged from agglomeration step 26 typically include excess moisture and require a moderate amount of drying to remove most of the residual free water present in the agglomerates. Removal of excess moisture is desired for the production of a free-flowing detergent product which will not clump or form aggregates during product storage. This drying is accomplished by continuously feeding the agglomerates 30 discharged from agglomerating step 26 to drying step 32. Drying step 32 typically comprises a fluid bed drying apparatus (not shown). Fluid bed dryers typically comprise multiple zones of the dryer with varying temperatures in each of the various zones. Fluid bed dryers are well-known in the art of detergent manufacture and are commercially available from a number of suppliers. The number of heating zones, drying temperatures, residence times and exiting temperatures of the agglomerates from the fluid bed dryer are all highly dependent upon the process conditions and the nature of the composition being produced and are all, of course, well-within the level of ordinary skill in the art. Preferably, the present invention employs a fluid bed dryer operated at product temperatures of about 30° C. to about 100° C. Optionally, drying step 32 may include a sizing stage (not shown) for the removal of undersized agglomerates or "fines." The undersized agglomerates may then be recycled via recycle stream 34 to agglomerating stage 26. Optionally, the process 10 of the present invention may include a cooling step (not shown) for the particles exiting the drying step via methods which are well-known in the art, for example, via a fluid bed cooler or airlift type apparatus.

Upon exiting drying step 32, the detergent agglomerates 36 are substantially dry and free-flowing agglomerates. By "substantially dry" it is intended that the detergent agglomerates 36 contain less than about 7% free moisture, more preferably less than about 5% free moisture and most preferably less than about 3% free moisture. The substantially dry detergent agglomerates 36 are then continuously passed to densification step 38 wherein the density of the agglomerates is increased while providing a superior particle size distribution. Densification step 38 comprises continuously charging a moderate speed mixer/densifier (not shown) with the substantially dry detergent agglomerates 36 and mixing the agglomerates to increase the bulk density of the agglomerates.

The moderate speed mixer/densifier according to the present invention is a mixer having a rotatable central shaft and typically has several radially extending arms. By "moderate speed" it is intended that the central shaft of the mixer is rotated at a speed of less than about 750 RPM, more preferably less than about 500 RPM and most preferably less than about 250 RPM yet typically greater than about 50 RPM. A suitable example of a moderate speed mixer/densifier suitable for use in the present invention is a Lödige KM "Ploughshare". The KM mixer has a rotatable central shaft and several arms extending from the central shaft with a triangular attachment on the end of the arms known as the "plow". Inside the mixer cavity are several smaller blades extending from the wall of the mixer which can be rotated at high speeds. Of course other moderate speed mixer/densifiers may also be employed in the present invention and are available from a variety of sources including Schugi, and conventional twin-screw mixers, commercially sold as Eirich, O'Brien and Drais mixers. The mixer may be operated at a shear rate of from about 100–900 inverse seconds, more preferably from about 200–800 inverse seconds and most preferably from about 250–750 inverse seconds. The shear rate as employed in the present invention is measured in inverse seconds and is defined by the formula:

$$\text{Shear Rate}=(5.23\cdot\text{Mixer Speed}\cdot\text{Mixer Diameter})/(\text{Gap})$$

where Mixer Speed is measured in RPM and is the speed of the mixer shaft; Mixer Diameter is the internal diameter of the mixer in meters and Gap is measured from the internal wall of the mixer to the edge of any arms extending from the mixer shaft and does not take into account any wall makeup. The mixer may also be operated at a percentage mixer fill of no less than about 10%, preferably no less than about 15% and most preferably no less than about 20% where the percentage mixer fill is defined by the formula:

$$\%\ \text{Mixer Fill}=\text{Working Volume}/\text{Mixer Volume}$$

where Mixer Volume is measured in liters and is further defined as:

$$\text{Mixer Volume}=3130\cdot\text{Mixer Length}\cdot(\text{Mixer Diameter})^2$$

when Mixer Diameter is defined as above and Mixer length is in meters and Working Volume is measured in liters and is defined by the formula:

$$\text{Working Volume}=(16.67\cdot\text{Feed Rate}\cdot\text{Residence Time})/(\text{Feed Material Density})$$

where Feed Rate is the rate at which agglomerates are fed into the mixer and is measured in kg/hr; Residence Time is mean residence time and is measured in minutes; Feed Material Density is the density of the agglomerates in the mixer and is measured in grams/liter.

An important component of the present invention is the mean residence time of the agglomerates in the moderate speed mixer/densifier. The substantially dry agglomerates 36 should be allowed to remain in the moderate speed mixer/densifier for a sufficient time to enable the desired density increase and particle size distribution to form. Preferably, the mean residence time of the agglomerates 36 in the moderate speed mixer/densifier is from about 3 minutes to about 20 minutes, more preferably from about 4 minutes to about 15 minutes, and most preferably from about 5 minutes to about 12 minutes.

The process 10 of the present invention may comprise adding an additional ingredient such as a binder or coating agent just before, in or after the moderate speed mixer/densifier of densification step 38 to provide an additional means by which the particle size may be controlled. Typical binder materials include water, anionic surfactants, nonionic surfactants, polyethylene glycol, polyacrylates, citric acid, water soluble silicates, and mixtures thereof. Other suitable binders materials including those listed are described in Beerse et al., U.S. Pat. No. 5,108,646 (Procter & Gamble Co.), the disclosure of which is herein incorporated by reference. Typical coating agents include aluminosilicates, carbonates, silicates and mixtures thereof. Binders and coating agents when added are generally added at levels of about 5% or less by weight of the composition. Of course, in the preferred embodiment, neither a coating agent nor a binder material is added to the moderate speed mixer/densifier.

Upon exiting densification step 38, the agglomerates are in the form of a high density agglomerated detergent 40. The high density agglomerated detergent is passed through a sizing step 42 where the detergent is passed over a screen, series of screens, or other sizing device (not shown) in order to remove oversized particles 44. Oversized particles 44 are passed to grinding step 46 where they are ground to acceptable sizes. The ground particles 48 are then recycled to high density detergent stream 40 to be passed through sizing step 42. Of course, one of ordinary skill in the art will recognize that the ground particles 48 may be recycled to various locations in process 10 including but not limited to densification step 38. Also, one of ordinary skill in the art will recognize that the required equipment for sizing step 42 and grinding step 46 are well known in the art and are available in a number of forms and from a number of suppliers.

Upon exit from sizing step 42, a properly sized high density detergent 50 is obtained. High density detergent 50 is at this point suitable for use as a detergent product and may be immediately packaged as a compact or high density detergent. However, in an optional step, the high density detergent 50 may be passed to an additional mixing step 52 where additional detergent ingredients may be added to the high density detergent if desired. Also optionally, an additional cooling step can be employed if desired to obtain a lower temperature prior to mixing step 52. Mixing step 52 employs a feed stream 54 of additional detergent ingredients which are continuously fed to a mixing apparatus (not shown). The mixer may be any type of mixer as is well known in the art but is preferably a low speed screw type mixer as is well known in the art. The additional detergent ingredients 54 may include, but are not limited to, enzymes, bleaching agents, perfumes, colorants, and other various detergent ingredients. These materials are admixed into the high density detergent 50 to thereby form a finished detergent product 56.

Accordingly, as can be seen by one of ordinary skill in the art, the process of the present invention produces a free-flowing agglomerated detergent composition, such as an automatic dishwashing detergent composition which has a high density of at least about 900 g/l, a superior particle size distribution and provides a detergent agglomerate which has a rounded or "ball-like" appearance rather than the traditional appearance of agglomerates. The detergent can be packaged as a compact product due to its high density and has a reduced amount of fines to minimize "dusting" when being poured during use. Thus, the process of the present invention provides superior consumer use detergent compositions.

Composition

From the aforementioned process, the present invention employs a number of ingredients to provide a suitable detergent product. The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Detergent Salts

The present invention may include both hydratable and nonhydratable detergent salts as hereinbefore described which provide the function of a builder in the product composition. The level of detergent salt/builder can vary widely depending upon the end use of the composition and its desired physical form. When present, the compositions will typically comprise at least about 1% detergent salt and more typically from about 10% to about 80%, even more typically from about 15% to about 50% by weight, of the detergent salt. Lower or higher levels, however, are not meant to be excluded.

Inorganic or P-containing detergent salts include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate salts are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate salts as builders are the alkaline earth and alkali metal carbonates as disclosed in German Patent Application No. 2,321,001 published on Nov. 15, 1973.

Aluminosilicate builders may also be added to the present invention as a detergent salt. Aluminosilicate builders are of great importance in most currently marketed heavy duty granular detergent compositions. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]_{xH2}O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Surfactants

Detersive surfactants included in the fully-formulated detergent compositions afforded by the present invention comprises at least 0.01%, preferably from about 0.5% to about 50%, by weight of detergent composition depending upon the particular surfactants used and the desired effects. In a highly preferred embodiment, the detersive surfactant comprises from about 0.5% to about 20% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

Particularly preferred surfactants in the preferred automatic dishwashing compositions (ADD) of the present invention are low foaming nonionic surfactants (LFNI). LFNI may be present in amounts from 0.01% to about 10% by weight, preferably from about 0.1% to about 10%, and most preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.6° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 100%, preferably from about 30% to about 70%, of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12\text{-}18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include those POLY-TERGENT® SLF-18 nonionic surfactants from Olin Corp., and any biodegradable LFNI having the melting point properties discussed hereinabove.

These and other nonionic surfactants are well known in the art, being described in more detail in Kirk Othmer's Encyclopedia of Chemical Technology, 3rd Ed., Vol. 22, pp. 360–379, "Surfactants and Detersive Systems", incorporated by reference herein.

Preferred are ADD compositions comprising mixed surfactants wherein the sudsing (absent any silicone suds controlling agent) is less than 2 inches, preferably less than 1 inch, as determined by the disclosure below.

The equipment useful for these measurements are: a Whirlpool Dishwasher (model 900) equipped with clear plexiglass door, IBM computer data collection with Labview and Excel Software, proximity sensor (Newark Corp.-model 95F5203) using SCXI interface, and a plastic ruler.

The data is collected as follows. The proximity sensor is affixed to the bottom dishwasher rack on a metal bracket. The sensor faces downward toward the rotating dishwasher arm on the bottom of the machine (distance approximately 2 cm. from the rotating arm). Each pass of the rotating arm is measured by the proximity sensor and recorded. The pulses recorded by the computer are converted to rotations per minute (RPM) of the bottom arm by counting pulses over a 30 second interval. The rate of the arm rotation is directly proportional to the amount of suds in the machine and in the dishwasher pump (i.e., the more suds produced, the slower the arm rotation).

The plastic ruler is clipped to the bottom rack of the dishwasher and extends to the floor of the machine. At the end of the wash cycle, the height of the suds is measured using the plastic ruler (viewed through the clear door) and recorded as suds height.

The following procedure is followed for evaluating ADD compositions for suds production as well as for evaluating nonionic surfactants for utility. (For separate evaluation of nonionic surfactant, a base ADD formula, such as Cascade powder, is used along with the nonionic surfactants which are added separately in glass vials to the dishwashing machine.)

First, the machine is filled with water (adjust water for appropriate temperature and hardness) and proceed through a rinse cycle. The RPM is monitored throughout the cycle (approximately 2 min.) without any ADD product (or surfactants) being added (a quality control check to ensure the machine is functioning properly). As the machine begins to fill for the wash cycle, the water is again adjusted for temperature and hardness, and then the ADD product is added to the bottom of the machine (in the case of separately evaluated surfactants, the ADD base formula is first added to the bottom of the machine then the surfactants are added by placing the surfactant-containing glass vials inverted on the top rack of the machine). The RPM is then monitored throughout the wash cycle. At the end of the wash cycle, the suds height is recorded using the plastic ruler. The machine is again filled with water (adjust water for appropriate temperature and hardness) and runs through another rinse cycle. The RPM is monitored throughout this cycle.

An average RPM is calculated for the 1st rinse, main wash, and final rinse. The % RPM efficiency is then calculated by dividing the average RPM for the test surfactants into the average RPM for the control system (base ADD formulation without the nonionic surfactant). The RPM efficiency and suds height measurements are used to dimension the overall suds profile of the surfactant.

Bleaching Agents

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the ADD compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While not preferred for ADD compositions of the present invention which comprise detersive enzymes, the present invention compositions may also comprise as the bleaching agent a chlorine-type bleaching material. Such agents are well known in the art, and include for example sodium dichloroisocyanurate ("NaDCC").

While effective ADD compositions herein may comprise only the nonionic surfactant and builder, fully-formulated ADD compositions typically will also comprise other automatic dishwashing detergent adjunct materials to improve or modify performance. These materials are selected as appropriate for the properties required of an automatic dishwashing composition. For example, low spotting and filming is desired—preferred compositions have spotting and filming grades of 3 or less, preferably less than 2, and most preferably less than 1, as measured by the standard test of The American Society for Testing and Materials ("ASTM") D355685 (Reapproved 1989) "Standard Test Method for Deposition on Glassware During Mechanical Dishwashing".

(a) Bleach Activators

Preferably, the peroxygen bleach component in the composition is formulated with an activator (peracid precursor). The activator is present at levels of from about 0.01% to about 15%, preferably from about 0.5% to about 10%, more preferably from about 1% to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. Nos. 5,130,045, Mitchell et al, and 4,412,934, Chung et al, and copending patent applications U.S. Ser. Nos. 08/064,624, 08/064,623, 08/064,621, 08/064,562, 08/064,564, 08/082,270 and copending application to M. Bums, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present detergent compositions preferably comprise a quaternary substituted bleach activator (QSBA) or a quaternary substituted peracid (QSP); more preferably, the former. Preferred QSBA structures are further described in copending U.S. Ser. Nos. 08/298,903, 08/298,650, 08/298,906 and 08/298,904 filed Aug. 31, 1994, incorporated herein by reference.

(b) Organic Peroxides, especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts

The present invention compositions and methods utilize metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}{}_2$(u-O)$_3$(1,4,7-trimethyl-1,4,7-triazacyclononane)$_2$($PF_6$)$_2$ ("MnTACN"), $Mn^{III}{}_2$(u-O)$_1$(u-OAc)$_2$(1,4,7-trimethyl-1,4,7-triazacyclononane)$_2$-($ClO_4$)$_2$, $Mn^{IV}{}_4$(u-O)$_6$(1,4,7-triazacyclononane)$_4$-($ClO_4$)$_2$, $Mn^{III}Mn^{IV}{}_4$(u-O)$_1$(u-OAc)$_2$(1,4,7-trimethyl-1,4,7-triazacyclononane)$_2$-($ClO_4$)$_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt catalysts which have the formula:

$$[CO(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula [Co($NH_3$)$_5$Cl] $Y_y$, and especially [Co($NH_3$)$_5$Cl]$Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are monocarboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, HOC(O)$CH_2$C(O)O—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —C(O)$NR'_2$, wherein R' is selected from the group consisting of hydrogen and $C_1$–$C_6$ moieties. Such substituted R therefore include the moieties —$(CH_2)_n$OH and —$(CH_2)_n NR'_4{}^+$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co\text{-}(NH_3)_5OAc]Cl_2$; as well as $[Co(NH_3)_5OAc](OAc)_2$; $[Co\text{-}(NH_3)_5OAc](PF_6)_2$; $[Co(NH_3)_5OAc](SO_4)$; $[Co\text{-}(NH_3)_5OAc](BF_4)_2$; and $[Co(NH_3)_5OAc](NO_3)_2$.

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.,* 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry,* 56, 22–25 (1952).

These catalysts may be coprocessed with adjunct materials so as to reduce the color impact if desired for the aesthetics of the product, or to be included in enzyme-containing particles as exemplified hereinafter, or the compositions may be manufactured to contain catalyst "speckles".

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

Detersive Enzymes

The compositions of the present invention may also include the presence of at least one detersive enzyme. "Detersive enzyme", as used herein, means any enzyme having a cleaning, stain removing or otherwise beneficial effect in an ADD composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred ADD compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in British Patent Specification No. 1,296,839 (Novo), RAPIDASE®, International Bio-Synthetics, Inc. and TERMAMYL®, Novo Industries.

Preferred amylases herein have the commonalty of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15, 197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S and are those referred to by the supplier as QL37+M197T.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

pH and Buffering Variation

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred ADD compositions herein comprise a pH-adjusting component selected from water-soluble alkaline inorganic salts and water-soluble organic or inorganic builders. The pH-adjusting components are selected so that when the ADD is dissolved in water at a concentration of 1,000–10,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantities of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 10% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium carbonate.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

Water-Soluble Silicates

The present automatic dishwashing detergent compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the $\delta Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the α-, β- and γ-forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® H20 from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

Material Care Agents

The present ADD compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminum protection is a concern and the composition is low in silicate. Generally, such material care agents include metasilicate, silicate, bismuth salts, manganese salts, paraffin, triazoles, pyrazoles, thiols, mercaptans, aluminum fatty acid salts, and mixtures thereof.

When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphtol and thioanthranol; and finely divided Aluminum fatty acid salts, such as aluminum tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

Adjunct Materials

Detersive ingredients or adjuncts optionally included in the instant compositions can include one or more materials for assisting or enhancing cleaning performance, treatment of the substrate to be cleaned, or designed to improve the aesthetics of the compositions. Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, chelants, enzymes, suds suppressors, dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, perfumes, solubilizing agents, carriers, processing aids, pigments, and pH control agents.

Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts.

Since ADD compositions herein can contain water-sensitive ingredients or ingredients which can co-react when brought together in an aqueous environment, it is desirable to keep the free moisture content of the ADDs at a minimum, e.g., 7% or less, preferably 5% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

The following nonlimiting examples further illustrate the process of the present invention.

EXAMPLE 1

An automatic dishwashing detergent agglomerate is prepared from the following ingredients:

| Material | Weight % |
|---|---|
| Powder sodium tripolyphosphate | 28 |
| Nonionic surfactant | 1 |
| Sodium Carbonate (Dense Soda Ash) | 30 |
| Sodium Sulfate | 21 |
| Aqueous Sodium Silicate (45% Solids) | 13 |
| Free Water | 2 |
| Enzymes and Bleach | Balance |

The sodium tripolyphosphate, surfactant, and about 7 parts by weight of water were metered and fed into a Schugi blender-agglomerator. The Schugi agitator shaft speed was 1200 RPM and was equipped with three sets of rotating knives. The top, middle and bottom knife sets were all adjusted to a +5° angle. The hydrated phosphate particles formed in the Schugi were continuously fed into a hydrator continuator. The hydrator shaft was running at 19 RPM and the mean residence time within this piece of equipment was 15 minutes. The particles discharged from this hydrator were then fed into another hydrator continuator running under the same RPM and mean residence time conditions as the first. The total mean residence time of the hydrated phosphate particles in the hydrator continuators was 30 minutes. By moisture test determinations of the particles discharged from the second hydrator, it was determined that 70% by weight of the sodium tripolyphosphate had been converted to the hexahydrate form.

The particles discharged from the second hydrator were then fed to a grinder where the larger particles were ground. The discharge of the grinder was then fed to a use bin.

The ground hydrated phosphate, the sodium carbonate, the sodium sulfate, and the aqueous sodium silicate were fed to a second Schugi blender-agglomerator in the right proportions to achieve the final product composition target. The second Schugi shaft speed was 1800 RPM and was equipped with three sets of rotating knives. The top, middle and bottom knife sets were all adjusted to a +5° angle.

The agglomerates discharged from the second Schugi were fed directly into a three zone fluid bed dryer. In the fluid bed dryer, about 5 parts of water by weight were removed from the incoming agglomerates so that the exiting agglomerate rate and the free moisture content of the agglomerates was ~2 parts by weight. Average exiting temperature was 90° F.

The agglomerates emerging from the fluid bed dryer were crisp and free flowing with the following particle size distribution and density:

Bulk Density (g/l) 850

Mean Particle Size (Microns) 1030

Cum. % On Tyler 12 Mesh 33

Cum. % On Tyler 14 Mesh 43

Cum. % Thru Tyler 60 Mesh 5

Cum. % Thru Tyler 100 Mesh 2

Cum. % Thru Tyler 270 Mesh <1

These agglomerates were then taken and fed into a KM Lödige 600 mixer. The KM Lödige 600 has the following dimensions:

Length (ft) 2.07

Diameter (ft) 6.43

Plow Bottom to Wall Gap (in) 0.50

The KM 600 shaft was running at 139 RPM and the exit gate was adjusted to hold 604 lbs of the agglomerates in the mixer during the continous trial. Based on the feed rate and weight of agglomerates in the mixer, the mean or average residence time of the agglomerates within the KM 600 was 12 minutes as measured by the load method wherein the load at steady state is divided by the throughput. Based on the Plow Bottom to Wall Gap and the RPM, the shear rate experienced by the agglomerates within the mixer was 721 $s^{-1}$. Assuming an average feed density of 850 g/l, the mixer was approximately 53% full. Two high speed (2700–3000 RPM) choppers were running inside the mixer.

The agglomerates emerging from the KM 600 had the following particle size distribution and density:

Bulk Density (g/l) 1065

Mean Particle Size (Microns) 550

Cum. % On Tyler 12 Mesh 8

Cum. % On Tyler 14 Mesh 12

Cum. % Thru Tyler 60 Mesh 14

Cum. % Thru Tyler 100 Mesh 6

Cum. % Thru Tyler 270 Mesh 0

The densified agglomerates were then sized through a Rotex screen containing a Tyler 14 Mesh equivalent screen the scalp off the oversized particles. The final particle size distribution and density was as follows:

Bulk Density (g/l) 1075

Mean Particle Size (Microns) 512

Cum. % On Tyler 14 Mesh 0

Cum. % Thru Tyler 60 Mesh 15

Cum. % Thru Tyler 100 Mesh 7

Cum. % Thru Tyler 270 Mesh 0

The sized and densified agglomerates were crisp and free flowing. Once densified and sized, enzyme and oxygen bleach were added to the agglomerates to form a finished detergent product.

EXAMPLE 2

An automatic dishwashing detergent agglomerate was prepared as described in EXAMPLE 1 up to the agglomerates exiting the fluid bed dryer.

The agglomerates exiting the fluid bed dryer were then fed into a KM Lödige 300mixer with one high speed (2700–3000 RPM) chopper running inside the mixer. The KM 300 shaft was running at 135 RPM and the mixer had the following dimensions:

Length (ft) 1.67

Diameter (ft) 4.92

Plow Bottom to Wall Gap (in) 0.50

Based on the Plow Bottom to Wall Gap and the RPM, the shear rate experienced by the agglomerates within the mixer was 281 $s^{-1}$. Mean residence time was adjusted between 10 and 14 minutes by adjusting the weight of the agglomerates inside the mixer from 173.5 lbs to 243 lbs. The density of the exiting agglomerates was found as follows:

| Residence Time (minutes) | Density (g/l) |
|---|---|
| 10 | 1039 |
| 14 | 1072 |

Particle Size Distribution data on the agglomerates exiting the KM mixer were similar to those outlined in EXAMPLE 1.

The densified agglomerates were then sized through a Rotex screen containing a Tyler 14 Mesh equivalent screen the scalp off the oversized particles. The density ranges were as follows:

| Residence Time (minutes) | Density (g/l) |
|---|---|
| 10 | 1045 |
| 14 | 1080 |

The sized and densified agglomerates were crisp and free flowing. Once densified and sized, enzyme and oxygen bleach were added to the agglomerates to form a finished detergent product.

What is claimed is:

1. A process for preparing a high density detergent composition without spray drying comprising the steps of:

a) drying detergent agglomerates to a free moisture content of less than about 7% by weight thereby forming substantially dry detergent agglomerates; and b) charging said substantially dry detergent agglomerates into a moderate speed mixer/densifier operating at a shear rate of from about 100 to about 800 inverse seconds to densify said substantially dry detergent agglomerates to form a high density detergent having a density of at least about 950 g/l and a particle size distribution of no more than 15% through Tyler Mesh 60.

2. The process as claimed in claim 1 wherein said high density detergent has a density in the range of from about 1000 to about 1150 g/l.

3. The process as claimed in claim 1 wherein said densifying step further comprises the step of passing said substantially dry detergent agglomerates through said mixer so that the mean residence time of said agglomerates in said moderate speed mixer/densifier is from about 3 minutes to about 20 minutes.

4. The process as claimed in claim 3 wherein the mean residence time of said agglomerates in said moderate speed mixer/densifier is from about 4 minutes to about 15 minutes.

5. The process as claimed in claim 1 wherein said densifying step further comprises the step of charging said substantially dry detergent agglomerates into said moderate speed mixer/densifier at a rate such that the percentage of mixer fill is no less than 10%.

6. The process as claimed in claim 5 wherein said percentage mixer fill is no less than 20%.

7. A process for preparing a high density detergent composition without spray drying comprising the steps of:

a) hydrating an anhydrous hydratable detergent salt to a degree of hydration of at least about 60%;

b) agglomerating said hydrated detergent salt by charging said hydrated detergent salt and additional detergent ingredients into a high speed mixer/densifier and agglomerating said hydrated detergent salt and said additional detergent ingredients to form hydrated detergent agglomerates;

c) drying said hydrated detergent agglomerates to a free moisture content of less than about 7% by weight thereby forming substantially dry detergent agglomerates; and d) charging said substantially dry detergent agglomerates into a moderate speed mixer/densifier operating at a shear rate of from about 100 to about 800 inverse seconds to densify said substantially dry detergent agglomerates to form a high density detergent having a density of at least about 950 g/l and a particle size distribution of no more than 15% through Tyler Mesh 60.

8. The process as claimed in claim 7 wherein said high density detergent has a density in the range of from about 1000 to about 1200 g/l.

9. The process as claimed in claim 7 wherein said densifying step further comprises the step of passing said substantially dry detergent agglomerates through said mixer so that the mean residence time of said agglomerates in said moderate speed mixer/densifier is from about 3 minutes to about 20 minutes.

10. The process as claimed in claim 7 wherein said densifying step further comprises the step of charging said substantially dry detergent agglomerates into said moderate speed mixer/densifier at a rate such that the percentage of mixer fill is no less than 10%.

11. The process as claimed in claim 7 wherein said step of hydrating said anhydrous detergent salt further comprises the steps of charging said anhydrous detergent salt, water and a surfactant into a high speed mixer/densifier and mixing said anhydrous salt, water and surfactant thereby forming a hydrated detergent salt.

12. The process as claimed in claim 11 wherein said hydratable detergent salt is selected from the group consisting of alkali metal phosphates, alkali metal carbonates, and mixtures thereof.

13. The process as claimed in claim 7 wherein said additional detergent ingredients in said step of agglomerating are selected from the group consisting of hydratable and non-hydratable detergent salts, detergent fillers, surfactants, coloring agents, bleaching agents, agglomerating agents, and mixtures thereof.

14. The process as claimed in claim 13 wherein said additional detergent ingredients are selected from the group consisting of alkali metal carbonates, alkali metal silicates, alkali metal sulfates, and mixtures thereof.

15. The process as claimed in claim 7 wherein said step of drying said hydrated detergent agglomerates further comprises the step of charging said hydrated detergent agglomerates to a fluid bed dryer.

16. The process as claimed in claim 15 wherein said fluid bed dryer is operated at a product temperature of from about 30° C. to about 100° C.

17. A process for preparing a high density detergent composition without spray drying comprising the steps of:

a) hydrating an anhydrous hydratable detergent salt to a degree of hydration of at least about 60%;

b) agglomerating said hydrated detergent salt by charging said hydrated detergent salt and additional detergent ingredients into a high speed mixer/densifier and agglomerating said hydrated detergent salt and said additional detergent ingredients to form hydrated detergent agglomerates;

c) drying said hydrated detergent agglomerates to a free moisture content of less than about 7% by weight thereby forming substantially dry detergent agglomerates; and d) charging said substantially dry detergent agglomerates into a moderate speed mixer/densifier operating at a shear rate of from about 100 to about 800 inverse seconds to densify said substantially dry detergent agglomerates to form a high density detergent having a density of at least about 1000 g/l.

18. A process for preparing a high density detergent composition without spray drying comprising the steps of:

a) drying detergent agglomerates to a free moisture content of less than about 7% by weight thereby forming substantially dry detergent agglomerates; and b) charging said substantially dry detergent agglomerates into a moderate speed mixer/densifier operating at a shear rate of from about 100 to about 800 inverse seconds to densify said substantially dry detergent agglomerates to form a high density detergent having a density of at least about 1000 g/l.

* * * * *